United States Patent [19]

Couarc'h et al.

[11] Patent Number: 4,739,715

[45] Date of Patent: Apr. 26, 1988

[54] PROCESS AND DEVICE FOR REINJECTING FLOWN-OFF PARTICLES INTO A SOLID FUEL BOILER

[76] Inventors: Michel F. E. Couarc'h, 31, rue Philippe de Beaumanoir, 78540 Vernouillet; Roger Bessouat, 15, rue Ribera, 75016 Paris; Marc R. R. Lafaye, 7, Avenue d'Edimbourg; Robert R. E. Bernet, 536 Route de Paris, both of 80 Amiens, all of France

[21] Appl. No.: 924,886

[22] Filed: Oct. 30, 1986

Related U.S. Application Data

[62] Division of Ser. No. 752,309, Jul. 3, 1985, Pat. No. 4,648,329.

[30] Foreign Application Priority Data

Nov. 9, 1983 [FR] France ..... 83 17811
Feb. 6, 1984 [FR] France ..... 84 01774

[51] Int. Cl.[4] ..... F23G 5/00

[52] U.S. Cl. ..... 110/346; 110/245; 110/255; 110/267

[58] Field of Search ..... 110/346, 255, 245, 270, 110/267

[56] References Cited

U.S. PATENT DOCUMENTS

| | | | |
|---|---|---|---|
| 4,434,724 | 3/1984 | Kunkel, Jr. | 110/267 |
| 4,476,790 | 10/1984 | Borio et al. | 110/245 |
| 4,481,892 | 11/1984 | Mah | 110/245 |
| 4,532,872 | 8/1985 | Anderson | 110/255 |

*Primary Examiner*—Henry C. Yuen

[57] ABSTRACT

A process for reinjecting flown-off particles into a solid fuel fire box of a boiler or furnace of the "projector with back grid" type, in which particulate fuel is projected from a fuel source adjacent a first zone to a grid, with the fuel burned along its trajectory from the first zone to a second zone on the grid. Means are provided for separately collecting both large and small fuel particles thrown off during combustion along the trajectory to the grid, and reinjecting the collected particles with the fine particles continuously reinjected at a rate approximately proportional to the boiler load at said second zone by means of a particle conveying air stream.

3 Claims, 4 Drawing Sheets

PROCESS AND DEVICE FOR REINJECTING FLOWN-OFF PARTICLES INTO A SOLID FUEL BOILER

This application is a division of application Ser. No. 752,309, filed July 3, 1985, now U.S. Pat. No. 4,648,329.

The present invention concerns a process and device for reinjecting flown-off particles during combustion in the fire box of a solid fuel boiler or furnace of the so-called "projector with back grid" type.

Such a boiler is characterised by the fact that it is fed with fuel, for example coal having a granulometry able to reach several tens of millimeters, or wood, husks, bagasse, or other comparable combustible solids, by fuel feed means arranged adjacent a first zone of the boiler and which project continuously a determined load of fuel along trajectory leading to a second zone of the boiler, onto a grid driven with a return movement from this second zone towards the first; combustion taking place during the course of the said trajectory and continuing not only during the end of it but also on the grid, where this combustion ends so that the grid drives only ashes into the first zone, whence these ashes are evacuated.

Boilers of this type have a certain number of advantages.

With respect to boilers with a mechanical grid, in which the combustion occurs exclusively on the grid, they have advantages connected with the fact that a part of the combustion occurs during the projection of the fuel, that is on the one hand an increase in the rate of combustion with the resultant possibility of reduction of the surface of the grid, and on the other hand a consequent flexibility of operation, permitting rapid changes of load to be made in the best conditions.

With respect to pulverised coal boilers, boilers of this type have the advantage of using coals of varied granulometry, and in particular coals of a greater granulometry which does away with crushing means, which are necessary for pulverised coal boilers and are costly in terms of investment, maintenance and consumption of energy.

Nevertheless, the development of boilers with a projector and a back grid has been limited until now, by reason of a lower output from than of other types of boilers, and more precisely because of the very important rate of combustible particles unburned.

In fact, the feed of fuel by projection permits the flying off, with the flue gases released by the combustion, of sufficiently light combustible particles to be thus entrained but nevertheless too heavy to burn completely in the course of the trajectory; This inconvenience is marked with respect to fixed grid boilers, where there is no projection, and with respect to pulverised coal boilers, which use coal of a sufficiently fine granulometry that the rate of unburned particles is minimal; In comparison with other types of boilers, an increase in the proportion of solid particles extracted from the flue gases, before evacuation to the atmosphere, by appropriate dust removers, with a greater proportion of carbon in the particles is noticed in the use of boilers with a projector and back grid; In other terms, an increase of losses and unburned solids is noted; In addition, the evacuation of solid particles extracted from the flue gases by the dust removers can present difficulties on account of their number.

For remedying these inconveniences of projector and back grid boilers, it has been proposed to reinject into the boiler a part of the solid particles flown off with the flue gases, after they have been caught at the outlet from the boiler by means of dust removers or separators used for purifying these flue gases before their being ejected into the atmosphere.

In practice, such dust removers or separators are normally provided in series, for extracting from the flue gasses first the larger particles and then the finer particles. Up to now the larger particles separated first have been reinjected, but the finer particles have not also being reinjected, since the fine particles are particularly difficult to burn before they fly off again, carried by the flue gasses. In other terms, up to now one has been limited to a reinjection of the larger particles insofar as there exists a significant risk that the reinjection of the finer particles will lead immediately to their flying off again, with or without combustion, together with the finer particles of the load introduced by the projector, with the result of a rapid coking up of the installation.

The object of the present invention is to eliminate such a risk, by permitting a total reinjection of the solid particles drawn off by the different successive dust removers or separators, including the finest particles separated immediately before ejection of the flue gases to the atmosphere.

For this, the process according to the invention, consists in a known manner of drawing off in a projector and back grid boiler the flue gases released by the combustion, entraining the solid particles, leading them then successively into means for separation of larger particles and into means for separation of finer particles, and evacuating the flue gases after this separation whilst the separated particles are reinjected into the boiler, characterised in that all the separated particles are reinjected into the boiler, in a manner possibly known insofar as it concerns the larger particles and, insofar as it concerns the finer particles furnished by corresponding separation means in an irregular flow, by means of operations consisting of:

(a) transforming this irregular flow into a continuous flow of particles, at least approximately proportional to the load of the boiler, (b) introducing continuously this continuous flow of particles into a continuous flow of conveying air, (c) leading these particles continuously into aproximately to the second zone of the boiler, and part of the said trajectory close to the grid.

In thus reinjecting the fine particles into the project precisely there where the finer particles of it are burning, the burning of the reinjected particles is facilitated and, in choosing that part of the trajectory into which this reinjection is made, the trajectory part closest to the grid, entrainment of the reinjected particles is facilitated. Deposit occurs in the intersection zone of the grid with the projection trajectory of the fuel; and, this zone constitutes precisely the hottest zone of the grid, which favours incineration of the reinjected particles being thus burned, that is to say the formation of ashes of which the flying off is no longer to be feared, and which can be evacuated with the other ashes when they reach the first zone of the boiler, as a result of movement of the grid.

It should be noted that this,flow, of fine particles, from the corresponding separation means can be very irregular, for example on accidental or voluntary discharge of the particles after significant variation of the load of the boiler. Transformation of this irregular flow into continuous flow approximately proportional to the load of the boiler, allows the combustion to be undisturbed by the reinjection in this boiler, that is to say of reinjecting at all values of load without irregularity of heat, whatever the perturbations which can affect the instantaneous flow rate of the means for separating the fine particles.

Naturally, the flow rate of conveying air must be such that this air does not greatly disturb the combustion inside the boiler, and particularly does not disturb the combustion of reinjected particles thus conveyed; taking account of the high carbon content of these particles and of their very low content of volatile material, it is convenient that the concentration of reinjected fine particles with respect to the air which conveys them should be sufficiently high, and one obtains good results with a ratio of mass flow rate of fine particles to mass flow rate of conveying air of the latter between 1 and approximately 10, these figures being given by way of non limitative example.

Further, the volume flow rate of conveying air is advantageously substantially constant, although adjustable, only the flow rate of the fine particles in this air varying, in order to assure a regular speed of injection.

Thus, the process according to the invention permits reinjection of all of the solid particles drawn off from the flue gases before evacuation of the latter to the atmosphere, and burning of the combustible part of these particles in the best conditions, this permits achievement of appreciable economies of combustion without causing elsewhere a complication of the installation; there results an optimal utilisation of the fuel, in all respects comparable to that which one achieves from a pulverised coal boiler, without it being necessary to provide a crusher, a particular inconvenience of such boilers.

It should be noted in addition that the total reinjection permits only extraction of the waste, in practice the ashes in a single zone and in a convenient form, easy to be retreated.

For putting this process into use, the present invention proposes in addition a device comprising:

means for drawing off the flue gases in the boiler, means for evacuation of the flue gases, first separation means for the separation of particles, second separation means for the separation of particles, means leading the flue gases from the drawing off means to the first separation means, from the first separation means to the second separation means, from the second separation means to the evacuation means of the flue gases, means for drawing off particles in the first separation means and of reinjecting such particles into the boiler, means for drawing off particles in the second separation means, this device being characterised in that the means for drawing off particles in the second separation means comprises:

(a) a buffer storage, (b) means for discharging particles from the second separation means into the buffer storage, preventing direct communication between these latter, (c) means for continuous drawing off of particles in the buffer storage, with an adjustable flow rate, (d) means for controlling in accordance with the load of the boiler the flow rate of the means for continuous drawing off of particles in the buffer storage, and in that there are provided:

a source of air under pressure, injection means arranged in the proximity of the second zone of the boiler and opening towards a part of the said trajectory close to the grid in this second zone, a pneumatically conveying duct connecting the source of air under pressure to the injection means, the means for continuous drawing off of particles in the buffer storage opening into the said duct.

In an advantageous embodiment of the device, the pneumatic conveying is made by the connection between, on the one hand, the means of discharging of particles from the second separation means into the buffer storage, and, on the other hand, this latter, which permits dissociation of these means for discharging and in particular the juxtaposition of these latter, that is to say not positioning them immediately below; for this, the device has a second source of air under pressure, a second pneumatic conveying duct connecting this second source to the buffer storage, the means for discharging of the particles from the second separation means into the buffer storage opening into this second duct preventing a direct communication between this latter and the second separation means.

Advantageously, it can then be provided that the source of air under pressure initially mentioned, intended to supply the pneumatic conveying duct leading the means for continuous drawing off of particles into the buffer storage by means of injection into the boiler, is constituted by an upper part of the buffer storage; in other terms, the same conveying air is used for successively leading to the buffer storage the particles from the means for discharging, and then to the boiler particles from the buffer storage.

Further, when the second separation means comprises a plurality of separators connected in series and/or in parallel, between the first separation means and the means for evacuation of the flue gases, via the flue, it is then possible to provide a discharging of all of these separators into a single buffer storage without the need to incorporate in the latter the plan dimensions corresponding to those of the assembly of the second separation means thus constituted; the device according to the present invention is then characterised in that there is provided means for discharging of particles from each of the separators into the single buffer storage, these means for discharging opening into the said second duct, which is common, preventing direct communication between this duct and the separators.

This solution is advantageous not only in terms of overcrowding, but also in terms of simplification of the means used for the adjustment of functioning, from the simple fact of the unique character of the buffer storage.

Whilst, when the second separation means have a plurality of separators connected in series and/or in parallel, between the first separation means and the means for evacuation of the flue gases, via the flue, the means for drawing off of the particles in the second separation means can equally be provided so as to comprise:

(a) a plurality of buffer storages of which each is associated with at least one separator, (b) means for discharging particles from this separator into the associated buffer storage, preventing a direct communication between these latter, (c) means for continuous drawing off of particles in each buffer storage, with an adjustable flow rate, (d) means for controlling to the load of the boiler the flow rate of each of the means for continuous drawing off of particles in one of the buffer storages, and that the means for continuous drawing off of particles in different buffer storages open into the mentioned pneumatic conveying duct, which is common.

Thus drawings off of particles into each buffer storage are able to be made which are both regular and apt to the mean production of the associated dust remover.

Advantageously, the means for controlling the flow of the means for continuous drawing off particles into the or each buffer storage to the load of the boiler comprise means for controlling this flow to maintain a mean level of particles in this buffer storage, and which permit the progressive absorption, without perturbation of the reinjection and the combustion of particles in the boiler, possible sharp variations of the load of particles received by the buffer storage as a result of the repercussion, with delay, of sharp variations of the load of the boiler, or again a discharge of the second separation means and more precisely, when these latter have several dust removers, of a discharge of one of these dust removers or several of them.

Other characteristics and advantages of the process according to the invention and of the device proposed for putting it into effect will appear from the following description of non-limitative examples, as well as from the accompanying drawings which form an integral part of this description.

Figure 1:
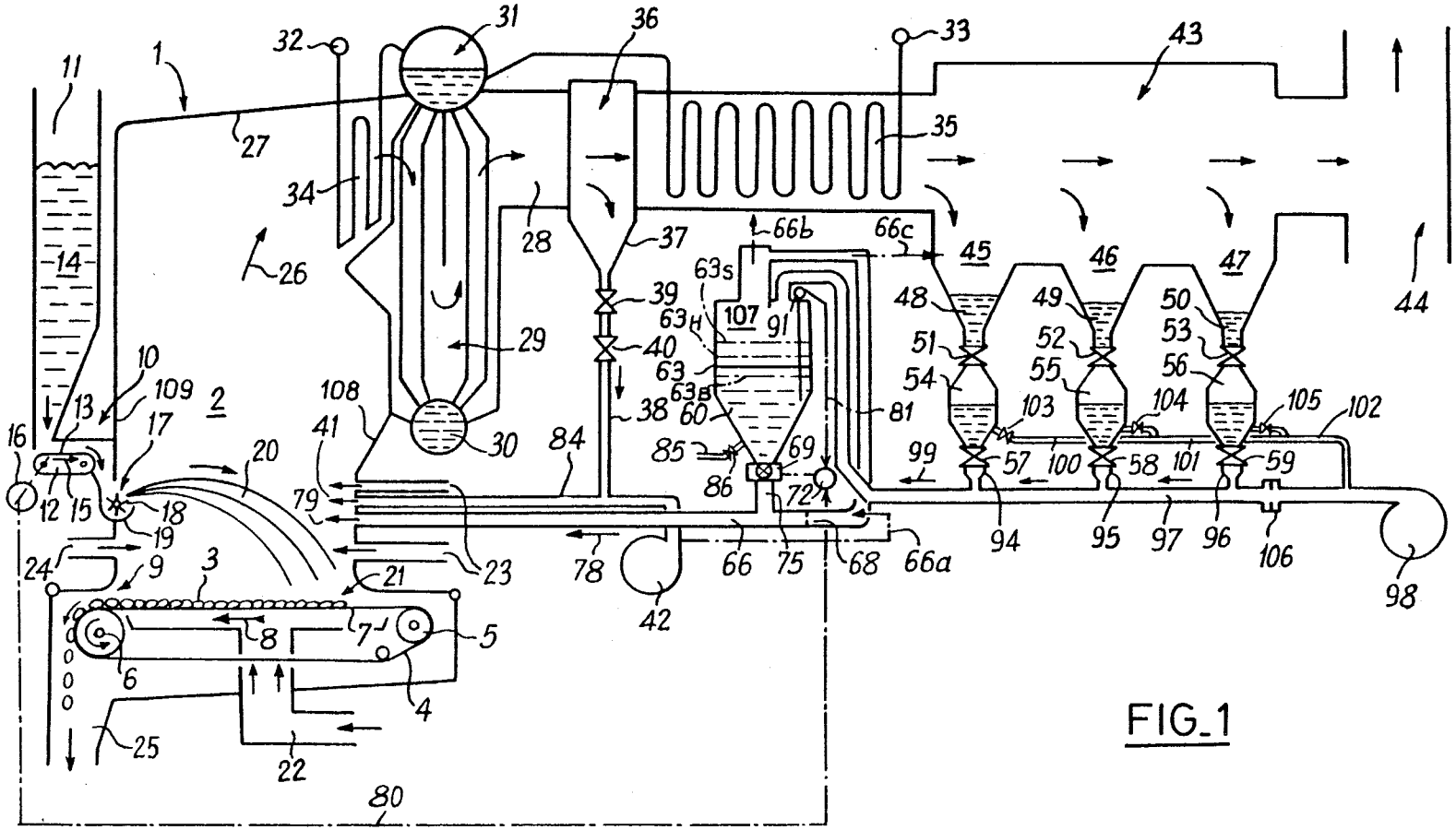
FIG. 1 shows the layout of a boiler with a projector and a back grid, equipped with a reinjection device putting into effect the process according to the invention.

Referring first to FIG. 1, where is designated by 1 a coal boiler, having internally a fire box 2 delimited below by an approximately horizontal grid 3 constituted by an endless conveyor 4 traversing from side to side of the boiler 1, approximately horizontally, and running around respectively from side to side over rolls means 5,6 which particularly define in the conveyor 4 an upper side 7, approximately horizontal, of which an intermediary zone between the rolls 5 and 6 constitute the grid 3. Motor means (not shown) drive the conveyer 4 so that its upper side 7 forming the grid 3 provide approximately horizontal translation in the direction of arrow 8.

A fuel source such as coal feed means 10 is arranged in a first zone at the downstream end of grid 3 in firebox 2. Feed means 10 open into fire box 2 and are formed with a storage hopper 11 outside the fire box of boiler 1 opening downwards above an endless conveyor 12 also outside the boiler 1, which has an upper side 13 approximately horizontal receiving the coal 14 from the storage hopper 11. Motor means 16 drive the endless conveyer 12 in a movement such that the upper side 13 is displaced in the direction indicated by arrow 15 carrying the coal 14 to projector device 17 disposed above the first zone 9 of the grid 3 and having blades 18 which a motor not shown drives in rotation about a horizontal axis spaced from fixed peripheral grid 19. Thus the coal driven by the upper side 13 of the conveyor 12 as far as the edge of the boiler 1 falls on to the device 17 and the latter projects this coal into the fire box 2, in a trajectory 20 hitting the grid 3 in a second zone 21 which constitutes its upstream zone with reference to the direction 8. In other words, the coal introduced by the projector device 17 crosses the fire box 2 from side to side for deposit on grid 3 in the second zone of the fire box 21 opposite the first zone 9 where the coal or other fuel is introducted into the fire box. The volumetric flow rate of coal 14 from the hopper 11 is adjusted by adjustment of the speed of displacement of the upper side 13 of the conveyor 12 in the direction 15, that is to say by adjustment of the output speed of the motor 16, the blades 18 being driven in rotation about their horizontal axis at a speed chosen as a function of the trajectory 20 to be achieved, so that it is defined as above.

Combustion of the thus introduced coal into the fire box 2 commences during the span of the trajectory 20 and continues on the grid 3, helped by the injection of primary air into the fire box 2 via a casing 22 opening into the fire box 2 under the upper side 7 of the conveyor 4, that is to say under the grid 3, and by injection of secondary air via pipes such as 23,24 opening into the fire box 2, in faces 108,109 of the boiler corresponding respectively to the upstream 21 and downstream 9 zones of the grid 3, at an intermediary level between that of the grid 3 and that of the projector device 17 as well as, preferably, at a higher level than that of the projector device 17, and close to this level.

The speed of displacement of the grid 3 in the direction 8 is established so that the coal on this grid in the upstream zone 21 of it is reduced to a state of ashes on its arrival at the downstream zone 9, this ash being evacuated by gravity on turning, by the conveyor 4, of deviation means 6 placed downstream with respect to the direction 8, as shown at 25.

The combustion of coal during the span of the trajectory 20 and on the grid 3 causes a release 26 of flue gases which the walls 27 of the boiler, delimiting the fire box 2 laterally and above, guide together towards an approximately horizontal duct 28, causing them to traverse an evaporator 29 comprising an array of vertical tubes connecting a lower drum 30 to an upper drum 31 for vaporising a liquid totally filling the lower drum 30 and the array of tubes, and partially the upper drum 31; the latter is connected above the liquid level to an outlet collector 32 of the vapour from the boiler, via the intermediary of a superheater 34 placed on the constrained passage of the flue gases, and below the level of liquid to a water inlet collector 33 in the boiler, via the intermediary of an economiser heat exchanger 35 also placed on the constrained passage of the flue gases.

The output speed of the motor 16 is controlled in accordance with the flow of vapour to satisfy the needs of the user, or the load of the boiler.

Boilers of this type are well known to the man in the art, who knows the manner of practical realisation of the different elements which have been described.

The duct 28 leads the flue gases drawn off in the boiler 1 successively to first separation means 36 intended to separate the larger particles, then to second separation means 43 intended to separate the finer particles before leading the flue gases thus freed of dust towards means for evacuation to the atmosphere, shown as 44.

The first separation means 36 can be constituted by any known device, adapted to carry out larger dust removal; they can be constituted for example by a mechanical dust remover, for example a centrifuge, or by the first field of an electrostatic separator.

As is already known in itself, means are provided for drawing off in these first separation means 36 the particles separated by these latter and reinjecting them into the boiler 1; in the preferred example of operation illustrated, where the only detail indicated of these first separation means 36 is a lower hopper 37, these means of drawing off and of reinjection comprise a vertical duct 38, provided with two juxtaposed valves 39,40 and into which the hopper 37 opens downwards, this duct 38 itself opening downwards into an intermediate zone of a horizontal duct 84 of a pneumatic conveyor connecting a source of air under pressure 42 to the fire box 2 of the boiler 1, into which this duct 84 opens approximately horizontally, as is indicated at 41, above the upstream zone 21 of the grid 3, at a level corresponding approximately to that of the projector 17 or at a lower level, so that the particles thus reinjected at 41 inside the boiler 1 are collected by the coal projected on the trajectory 20 by the projector 17, and then follow this trajectory with the thus projected coal.

The parameters of this reinjection of the larger particles separated from the flue gases in the means 36 can be easily determined by the man of the art; one can moreover choose other means, already known, of reintroduction of such particles into the fire box, as for example a reintroduction by the projector 17, taking into account the granulometry of the particles thus reinjected at 41, the combustion of these particles without their flying off, together with the coal introduced on the trajectory 20 by the projector 17, does not pose particular problems indicated above, connected with the reinjection of particles of a finer granulometry, and for it one resorts to the present invention.

It should be noted that all the larger particles separated from the flue gases by the first separation means 36 are thus reinjected at 41 into the fire box 2; the means permitting also reinjection of the totality of the finer particles separated later, in the second separation means 43 to which the duct 28 leads the flue gases after they have had removed from them the larger particles in the first separation means 36 and before being evacuated to the atmosphere by the means 44, will now be described.

By way of non-limitative example, the case is illustrated where the second separation means 43 are constituted by three separators 45,46,47, which the flue gases traverse successively in this order, in series, there losing particles respectively more and more fine collected in a lower hopper respectively 48,49,50 of these separators 45,46,47; these separators can be either fields of the same electrostatic dust remover, or dust removers of a different type.

Each of these hoppers 48,49,50 opens downwards onto a respective valve 51,52,53 able to close in a gas-tight manner or to open for permitting the descent, by gravity, of the solid particles collected.

Under each of the valves 51,52,53 is disposed a respective intermediary hopper 54,55,56, fluid-tight, having an interior volume such that on each opening of the associated valve 51,52,53, it can receive the entire charge of solid particles from the lower hopper 48,49,50 of the associated separator 45,46,47.

For this, in use, an opening then closing of each valve 51,52,53, normally closed, for emptying the lower hopper 48,49,50 of the corresponding separator is carried out either when the latter contains a pre-determined volume of particles, as a function of which is chosen the volume of the intermediate associated hopper 54,55,56, or cyclically with a periodicity chosen such that the volume of particles in this lower separator hopper never exceeds this predetermined volume.

Each of the intermediary hoppers 54,55,56 opens downwards onto a valve 57,58,59 in all respects similar to the valves 51,52,53.

Inside each of the intermediary hoppers 54,55,56, at the bottom of the lower part of it, opens a respective duct 100,101,102 branched off onto a duct 97 which will be described below, and which carries air under pressure from a volumetric compressor 98; each of these ducts 100,101,102 permits injection into the associated intermediary hopper 54,55,56, fluidisation air for the particles in it, the flow of this air being able to be regulated individually by an appropriate valve 103 from the duct 100, 104 from the duct 101, 105 from the duct 102.

The particles are thus held, in each of the intermediary hoppers 54,55,56 in a state of fluidity such that they can be easily poured out downwards when the valve 57,58,59 is open.

Downwardly, each valve 57,58,59 opens onto a respective vertical duct for evacuation by gravity 94,95,96 and the different ducts 94,95,96 themselves open downwardly into the approximately horizontal duct 97 mentioned above, in positions spaced along it downstream of the zone whence lead off the ducts 100,101,102 for fluidisation air with reference to the direction 99 of air circulation in this duct 97, imposed by the volumetric compressor 98; a diaphragm 106 is interpsoed in the duct 97 between the mouth of the different ducts 94,95,96 and the opening of the ducts 100,101,102 for causing a passage of air into the latter.

Thus, the air carried by the duct 97 in accordance with a flow adjustable by adjustment of the volumetric compressor 98 can successively carry along the drawn off particles in the intermediary hopper 56 when the valve 59 is open, and which fall via the duct 96, the drawn off particles in the intermediary hopper 55 when the valve 58 is open, and which fall via the duct 95, and the drawn off particles in the intermediary hopper 54 when the valve 57 is open, and which fall via the duct 94; it should be noted that this order, chosen by way of example, is not a characteristic of the invention and is not limitative of it.

Upstream of the assembly of the ducts 94,95,96 with reference to the direction 99, the air circulating in the duct 97 carries in this direction 99 the assembly of particles thus collected as far as the upper part 107 of a single buffer storage 60, fluid-tight, delimiting an internal volume greater than the sum of the respective volumes of the intermediary hoppers 54,55,56 so that it can always contain a volume of particles greatly superior to the volume which can arrive from the intermediary hoppers 54,55,56 when the valves 51,52,53 connecting these with the respective associated separators 45,46,47 are opened; in addition the volume and shape of the buffer storage 60 is such that, when it receives, via the pneumatic conveyor duct 97, from the intermediary hoppers 54,55,56 a charge of solid particles by opening of the valves 57,58,59, there follows in the buffer storage a small variation of level of the load of solid particles in it.

The practical arrangements which can be adopted for this can be varied to a great extent, and will be chosen by the man in the art without departing from the scope of the present invention.

For example, the buffer storage 60 has a lower part in the form of a hopper progressively narrowing downwards, and an upper part 107 of constant cross-section in a horizontal plane, the lower part being intended to be permanently full of particles throughout its height, as well as the upper part 107 in part of its height.

With the buffer storage 60 is also associated a mean upper level 63 of its load of particles; a level detector 91, associated with the buffer storage 60, permits detection and either quantification, or comparison with a predetermined threshold or several predetermined thresholds, the possible differences between the actual level of particles in the buffer storage and the predetermined mean level 63, corresponding to this buffer storage; such detectors are known to the man in the art.

Each intermediary hopper 54,55,56 constitutes an air lock permitting the passage of particles from the lower hopper 48,49,50 of the respective associated separator 45,46,47 to the buffer storage 60, via the duct 97, whilst preventing direct communication, with the possibility of passage of gas, between the internal volume of this buffer storage and the separators 45,46,47; for this, in use, each of the valves 51,52,53 is only opened on the condition that the valve 57,58,59 associated with the same intermediary hopper 54,55,56 is closed, and each of the valves 57,58,59 is only opened on the condition that the valve 51,52,53 associated with the same intermediary hopper 54,55,56 is closed; in practice, an opening then closing of each valve 57,58,59, normally closed, for emptying the associated intermediary hopper 54,55,56 occurs after each opening and closing of the corresponding valve 51,52,53.

Other means can naturally be chosen for permitting the passage of solid particles collected by one of the separators 45,46,47 to the buffer storage 60, but the choice of such an air lock has permitted the obtaining of entire satisfaction in the operating conditions of the device, that is to say taking into account that the solid particles considered are present in the form of dust.

Inside the buffer storage 60, at the bottom of the lower part of it, opens a duct 85 which permits injection into the buffer storage 60 of fluidisation air for the particles in it, the flow of this air being able to be adjusted by an appropriate valve 88 in the duct 85; this air coming for example from the source 42, the duct 85 being then branched off from the duct 84, between this source 42 and the mouth of the duct 38, in a manner not shown but analogous to that which has been described with reference to the ducts 100,101,102 and 97.

The particles are thus maintained, in the buffer storage 60, in a fluid state such that they can be easily drawn off by drawing off means at a continuous, adjustable flow rate, onto which this buffer storage 60 opens downwards; these drawing off means have been designated by 69 and advantageously are constituted by a rotary air lock or cellular distributor, having as is known a plurality of blades driven in rotation about an axis, by a motor 72, inside an envelope with which the blades delimit cells which the rotation of the blades puts into communication alternatively with the buffer storage 60, upwards, and, downwards, with the vertical duct 75 for evacuation by gravity; the flow rate of such a cellular distributor, in terms of volume flow rate or mass flow rate, is controlled by the speed of rotation of the blades, that is to say by their speed of driving by the associated motor 72.

Downwards, the duct 75 opens into an approximately horizontal section of a duct 66 which takes air under pressure, supplied from the volumetric compressor 98 via the duct 97, into the upper part 107 of the buffer storage 60 and carries this air in a circulation direction 78; a throttle 68 is interposed in the duct 66, between its opening into the upper part 107 of the buffer storage 60, and the opening of the duct 75 into this duct 66, for establishing at the opening of the duct 75 a pressure lower than that present in the upper part 107 of the buffer storage 60.

From this, the air carried by the duct 66, according to a flow rate regulated by the volumetric compressor 98, carries along the particles removed in the buffer storage 60 according to a flow rate predetermined by the cellular distributor 69, and which fall via the duct 75.

Downstream of the connection of the duct 75, with reference to the direction 78, the air circulating in the duct 66 carries in this direction 78 the particles thus collected as far as the injection means 79 of a type known in themselves, used for the injection of dusty materials into boilers, which injection means 79 open into the fire box 2 approximately horizontally, above the upstream zone 21 of the grid 3, at a level which is intermediary between the levels of the pipes 23,24 for injection of secondary air and correspond at least approximately to the level of injection 41 of the larger particles separated by the first separation means 36; the injection means 79 are directed towards the trajectory 20, and more precisely towards a part of it close to the grid in the upstream zone 21 of this, for favouring the carrying along of the fine particles thus injected at 79 by the coal projected by the projector device 17 on the trajectory 20, and the following of this trajectory as far as the grid 3 by these fine particles.

Conforming with the present invention, the flow of the conveyor air for the particles in the duct 66 and the flow of particles in this air, via the drawing off means in the buffer storage 60, here constituted by the cellular distributor 69, are continuous, and the flow of particles upstream of the opening of the duct 75 into the duct 66, expressed in terms of mass flow rate or volume flow rate, is at least approximately proportional to the load of the boiler, for example to the flow rate of the feed means 10 expressed in the same units, which is representative of this load.

For this, the flow rate of the drawing off means in the buffer storage 60, that is to say the cellular distributor 69, is controlled in accordance with the load of the boiler in a manner to be at least approximately proportional to it.

Taking account of this, in the steady state, substantially constant load of the boiler and for a coal of predetermined characteristics, the flow rate of solid particles collected in the dust removers 45,46,47 then led to the buffer storage 60 is substantially proportional to the feed rate of the boiler with coal 14 from the hopper 11, itself representative of the load of the boiler, it has been provided for this, in the embodiment illustrated, a control of the motor 72 to information furnished by the level detector 91, in a manner to limit the variations of the level of particles in the buffer storage 60 in comparison with the predetermined mean level 63; it should be noted that thus in addition is assured from this that the drawing off means 69 receive particles, in the buffer storage 60, an approximately constant force permitting them to work in conditions themselves approximately constant, independently of the respective emptyings of the intermediary hoppers 54,55,56.

The means for permitting control as to the speed of the motor 72 to the information furnished by the level detector 91 has been shown by a chain dotted line 81; they can be chosen by the man of the art within a large range of possibilities without departing from the scope of the present invention, as a function particularly of the type of level detector 91 utilized in accordance with the case a step by step correction or the possibility of a continuous correction.

For example, in accordance with the preferred embodiment, the level detector 91 permits detection of the passing of the actual level of particles in the storage 60 at two different levels, by reason of a bottom level 63B and a top level 63H of which the mean defines the mean level 63, and emitting at an adjustable interval impulses representative of the one of these two levels which is actually reached by these particles; the control of the rate of the cellular distributor 69, that is to say the speed of the motor 72 of it, to the information thus furnished by the detector 91 can be carried out in the following manner in the case:

on the starting of the installation, the buffer storage 60 being presumed to be initially empty, and until the top level 63H is reached following successive emptyings of the intermediary hoppers 54,55,56 into the storage buffer 60, the motor 73 is driven at a predetermined minimum speed of rotation, which corresponds to a reinjection of particles at 79 at a minimal flow rate;

the level 63H having been attained, which is confirmed by the sending, by the detector 91, of a predetermined number of corresponding pulses, the control means 81 causes an increase in the predetermined value of the speed of rotation of the motor 72; if, then, a same predetermined number of pulses sent by the detector 91 testify to the fact that the level 63H is still reached or exceeded, the control means 81 cause a further increase in speed of the motor 72, to the same predetermined value, and this process of increase of the speed of the motor 72 is continued until the actual level of particles in the buffer storage 60 redescends below the top level 63H, to which the pulses from the detector 91 testifies;

when the top level 63H is thus dropped below, the actual level of particules nevertheless remains above the bottom level 63B, the control means 81 hold constant the rotation speed of the motor 72;

if the actual level of the particles in the buffer storage 60 rises again to reach once more the level 63H, the recited process starts again;

if the level in the buffer storage 60 redescends below the bottom level 63B, the emission by the detector 91 of the said predetermined number of corresponding impulses causes, by the control means 81, a reduction of the rotation speed of the motor 72, in accordance with the predetermined mentioned value; this process can be repeated either until the bottom level 63B is once more reached, and then interrupted, or until the mentioned minimum speed is reached, if the actual level of particles in the buffer storage 60 does not reach again the bottom level 63B;

particularly, on stopping of the installation, the dropping below the bottom level 63B leads to the rotation speed of the motor 72 being the mentioned minimum speed, which returns the installation to its initial state.

In addition, a detection can advantageously be provided for the possible passage of the level of particles, in the buffer storage 60, above a safety level 63S higher than the level 63H, by means of the detector 91 or another level detector, with a control such that the passing of this level 63S stops the extraction of particles in the intermediary hoppers 54,55,56 and their pneumatic conveying, via the duct 97, as far as the buffer storage 60, this extraction and this conveying automatically restarting when the safety level 63S is once more descended from.

Advantageously, for permitting an absorption of variations in the quantity of particles received by the dust removers 45,46,47 consecutively to the repercussion, with delay, of a significant variation in the load of the boiler or again to a discharge of these dust removers, with perturbation of the conveying via the duct 66 and without the reinjection into the fire box at 79 causing excessive variations in the release of heat, an arrangement can be provided for adjustment of the output speed of the motor 72 as a function of informations provided by the level detector 91, by means of a tendency signal representiative at each instant of the load of the boiler and which is exploited in the direction of a proportionality of flow rate to the means of drawing off into the buffer storage 60, that is to say of the cellular distributor 69, to this load; the means used for this, which can be chosen by the man of the art from a large range of possibilities and as a result are shown only by a chain dotted line 80, tend for example to connect in a ratio of predetermined proportionality, as a function of the quantities of solid particles waiting in the dust removers 45,46,47 for the determined loads of the boiler taking account particularly of the characteristics boiler taking account particularly of the characteristics of the coal used, the speed of rotation of the motor 72 to that of the motor 16, which is representative of the load of the boiler.

A regular reinjection of particles is thus assured.

Figure 2:
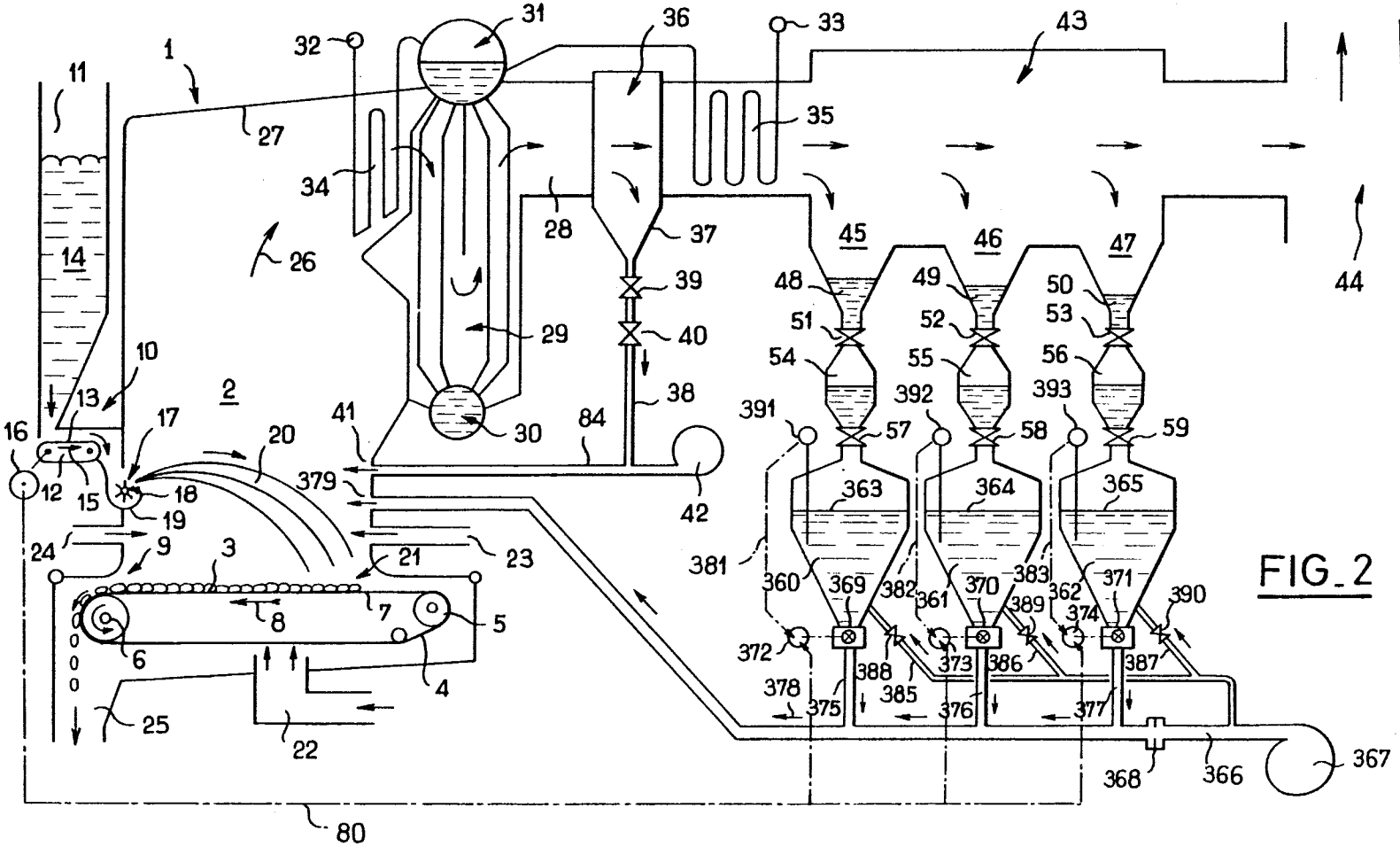
FIG. 2 shows a layout of a boiler with a projector and a back grid, equipped with a variant of the reinjection device according to the invention.
Figure 3:
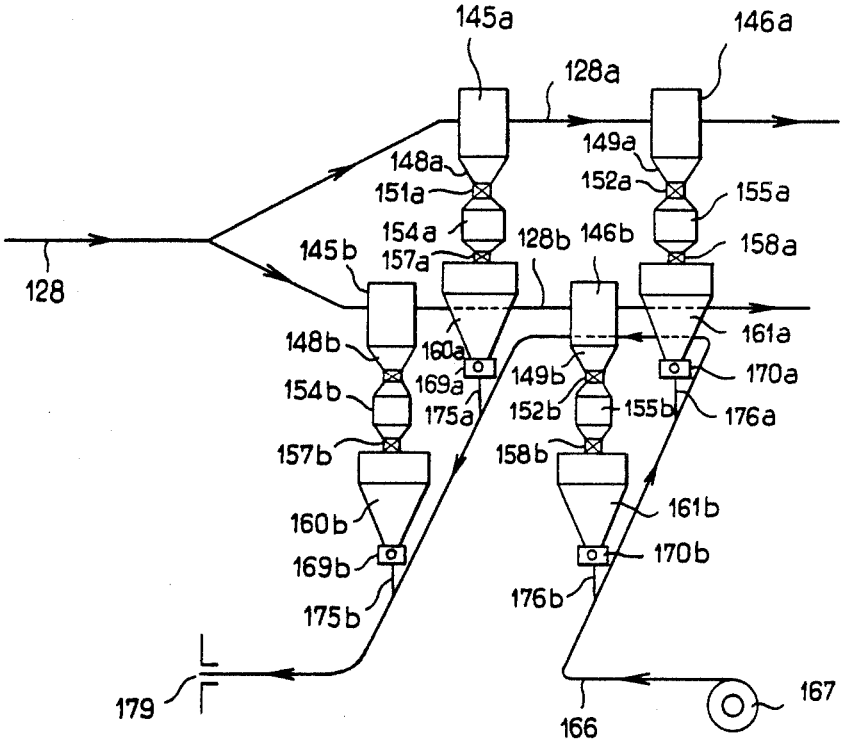
FIGS. 3 and 4 illustrate two variants of branching of second separation means, in the body of this variant of the device.
Figure 4:
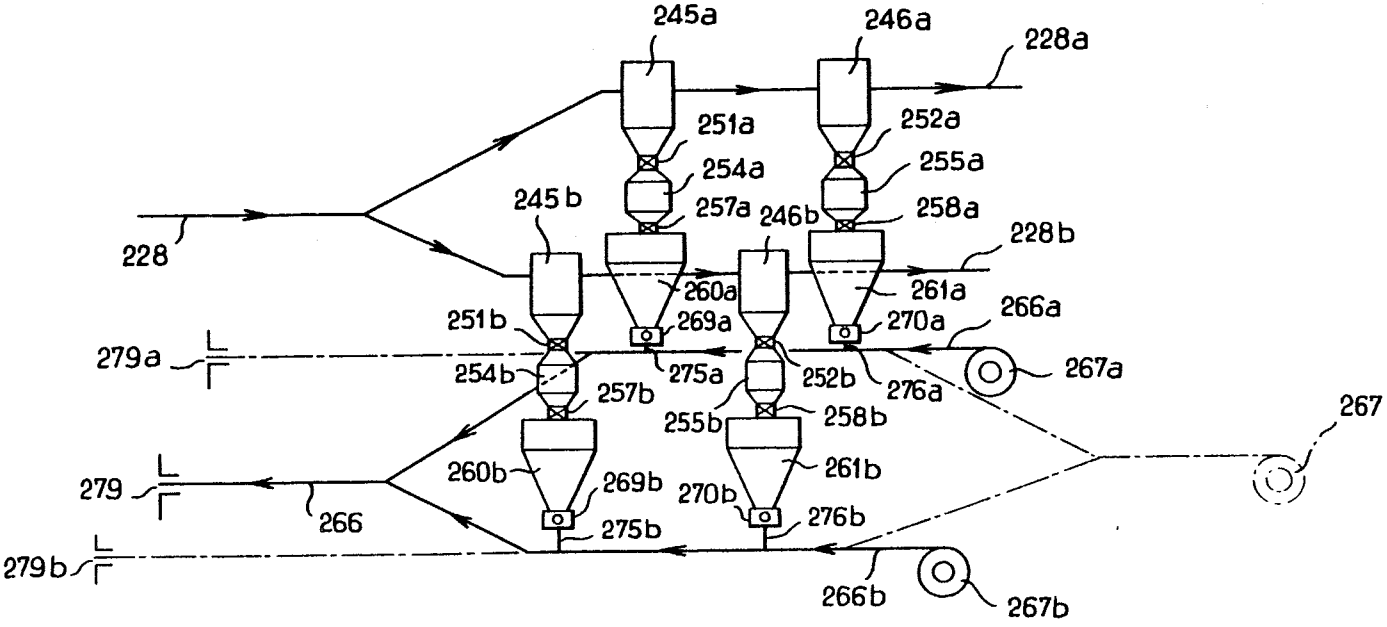

It should be noted that the manner of control of the flow rate of the means for drawing off into the buffer storage 60 to the load of the boiler, in the direction of at least approximate proportionality, which have been described, give priority to the detection of the level of particles in the buffer storage 60 and intervenes only in terms of tendency of the load of the boiler at the instant considered, can be replaced by a manner of control in the direction of such proportionality which will be described below with reference to FIGS. 2 to 4, intervening firstly to the load of the boiler and to the correction of the detection of the level in the buffer storage or in each buffer storage;

on the other hand, the manner which has been described can be adapted for the assembly or for each of the buffer storages which will be described with reference to FIGS. 2 to 4.

The flow of particles into the duct 66 being thus determined, the flow of conveying air in this duct, preferably constant in terms of volume flow rate, is adjusted by action on the volumetric compressor 98 such that the mass flow rate of particles introduced into the duct 66 is in a ratio to mass flow rate of air in this duct of between 1 and approximately 10; these figures, given by way of non limitative example, correspond to a high concentration of suspension of particles in air injected at 79 into the boiler, such a high concentration being favourable to the combustion of these particles on their arrival in the boiler and their incineration into the form of ashes once they are burned and arrive on the grid 3.

Illustrated by chain dotted lines on FIG. 1, are two variants of the device which have been described.

These two variants have as a common characteristic that instead of being supplied with air under pressure by the volumetric compressor 98, via the duct 97 and the upper part 107 of the buffer storage 60, the duct 66 ensuring the pneumatic conveying, towards the injection means 79, of particles drawn off in the latter by means 69 is fed via a blower (a non-illustrated variant) or by the same blower 42 as the duct 84 as is illustrated at 66a; then, the air introduced into the upper part 107 of the buffer storage 60 by the volumetric compressor 98 can be either evacuated as free air, as is shown at 66b, after filtering by appropriate means, or more advantageously be reinjected into the second separation means 43, as is shown at 66c.

Referring now to FIG. 2, where will be found under the same references, identical both as to their nature and cooperation, elements 1 to 59 and 84 of FIG. 1, possibly shown in a more schematic manner.

This varied embodiment of the device differs from that of FIG. 1 in that each valve 57,58,59 opens downwards on to the respective buffer storage 360,361,362 in a fluid tight manner, delimiting an interior volume greater than that of the associated intermediary hopper 54,55,56 so that it can contain permanently a volume of particles greatly superior to the volume which can arrive in the associated intermediary hopper 54,55,56 when the connecting valve 51,52,53 of it with the associated separator 45,46,47 is open; in addition, the volume and form of each buffer storage 360,361,362 are such that when it receives from the associated intermediary hopper 54,55,56 a load of solid particles by opening of the connecting valve 57,58,59, there follows in the buffer storage a small variation of level of load of particles in it.

The practical arrangements able to be adopted for this can be varied in a large measure, and will be chosen by the man of the art without departing from the scope of the present invention.

For example, each of the buffer storages 360,361,362 has a lower part in the form of a hopper, progressively narrowing downwards, and an upper part of constant cross-section in a horizontal plan, the lower part being intended to be filled permanently with particles throughout its full height as is the upper part through part of its height.

To each buffer storage 360,361,362 is thus associated with an upper mean level 363,364,365 of its load of particles; a level detector 391,392,393 respectively associated to each buffer storage 360,361,362 permitting detection and either quantification, or comparison with a predetermined threshold or several predetermined thresholds, the possible differences between the actual level of particles in the buffer storage under consideration and the predetermined mean level 363, 364,365 corresponding to this buffer storage; such detectors are known to the man in the art.

Each intermediary hopper 54,55,56 constitutes an air lock permitting the passage of particles from the lower hopper 48,49,50 of the respectively associated separator 45,46,47 to the corresponding buffer storage 360,361,362 without at any instant, the internal volume of this latter being put into direct communication, with the possibility of passage of gas, with the separator 45,46,47; for this, in use, each of the valves 51,52,53 is only opened on the condition that the valve 57,58,59 associated with the same intermediary hopper 54,55,56 is closed and each of these valves 57,58,59 is only opened on the condition that the valve 51,52,53 associated to the same intermediary hopper 54,55,56 is closed; in practice, an opening and then closing of each valve 57,58,59, normally closed, for emptying the associated intermediary hopper 54,55,56 intervenes after each opening and closing of the corresponding valve 51,52,53.

Other means can naturally be chosen for permitting the passage of solid particles collected by one of the separators 45,46,47 to the respective associated buffer storage 360,361, 362 but the choice of such air locks permits obtaining entire satisfaction in the operating conditions of the device, that is to say taking account of the solid particles in consideration being in a dusty state.

At the interior of each of the buffer storages 360,361, 362 at the bottom of the lower part of it, opens a respective duct 385,386,387 branched onto the duct 366 which will be described below, and which carries the air under pressure supplied from a blower 367; each of these ducts 385,386,387 permits injection into the associated buffer storage 360, 361,362 of air for fluidisation of the particles in it, the flow rate of this air being able to be adjusted individually by an appropriate valve 388 in the duct 385, 389 in the duct 386, 390 in the duct 387.

The particles are thus maintained, in each of the buffer storages 360,361,362 in a state of fluidity such that they can be easily drawn off by the drawing off means at a continuous adjustable flow rate on which this buffer storage 360,361,362 opens downwards; designated by 369,370,371, are drawing off means associated respectively to the buffer storage 360,361,362; each of these drawing off means 369,370,371 is advantageously constituted by a rotary air lock or cellular distributor, having as is known a plurality of blades driven in rotation about an axis, by a respective motor 372,373,374, inside an envelope with which these blades delimit cells which the rotation of the blades puts into communication alternatively with the associated buffer storage 360,361,362, upwardly, and, downwardly, with a vertical duct 375,376,377 for evacuation by gravity; the flow rate of such a cellular distributor, in terms of volume flow rate or mass flow rate, is controlled by the speed of rotation of the blades, that is to say by their drive speed by the associated motor 372,373,374.

Downwards, each of the ducts 375,376,377,opens into the duct 366 mentioned above, approximately horizontal, in positions spaced along the length of it downstream of the zone whence branch off the ducts 385,386,387 for fluidisation air with reference to a direction 378 of circulation of air in this duct 366, imposed by the blower 367; a diaphragm 368 is interposed in the duct 366 between the opening of the different ducts 375,376,377 and the opening of the ducts 385,386,387 for causing a passage of air in these latter.

From this, the air carried by the duct 366, in accordance with a flow rate adjusted by adjustment of the blower 367, carries along successively the particles drawn off in the buffer storage 362 according to a flow rate determined by the cellular distributor 371, and which fall via the duct 377, the particles drawn off in the buffer storage 361, according to a flow rate determined by the cellular distributor 370, and which fall via the duct 376, and the particles drawn off in the buffer storage 360 according to a flow rate determined by the cellular distributor 369, and which fall via the duct 375; it should be noted that this order, chosen by way of example, is not a characteristic of the invention and as a result is not limitative on it; other manners of connection will in any case be described below, with reference to FIGS. 3 and 4.

Downstream of the connection of all the ducts 375, 376,377 with reference to the direction 378, the air circulating in the duct 366 carries in the direction 378 all the particles thus received as far as the injection means 379 in all respects the same as the injection means 79 described with reference to FIG. 1, and arranged in the same manner as the latter with respect to the grid 3, to the pipes 23 and 24, and to the level of injection 41 of larger particles separated by the first separation means 36; in particular, the injection means 379 are oriented towards the trajectory 20, and more precisely towards a part of it close to the grid in the upstream zone 21 of it, for favouring the carrying along of the fine particles thus injected at 379 by the coal projected by the projector device 17 on the trajectory 20, and the following of this trajectory as far as the grid 3 by these fine particles.

In conformity with the present invention, as well as the flow rate of air in the duct 366, considered as a flow rate of conveying air taking account of the negligible characteristic of the part of this flow rate serving for fluidisation in the buffer storages 360,361,362, and the flow rate of particles in this air, via the drawing off means in the buffer storages 360,361,362 here constituted by the cellular distributors 369,370,371 are continuous, and the flow rate of particles downstream of the assembly of ducts 375,376,377, expressed in the terms of mass flow rate or volume flow rate, is at least approximately proportional to the load of the boiler, for example to the flow rate of the feed means 10 expressed in the same units.

For this, in conformity with the exbodiment illustrated in FIG. 2, it is the flow rate of each of the drawing off means in the buffer storages 360,361,362, that is to say each of the cellular distributors 369,370,371, which is thus controlled by the load of the boiler in a manner itself to be at least approximately proportional and, to this end, a control of each of the motors 372,373,374 to the motor 16, has been provided, in a manner to connect in a ratio of predetermined proportionality the respective output speeds of these motors; these control means, shown by a connection in chain dotted lines 380, can be chosen by the man in the art from amongst a large range of possibilities and as a result will not be described.

By an appropriate adjustment of the ratio of proportionality, as a function of the quantities of solid particles waiting in each of the dust removers 45,46,47 for the predetermined loads of the boiler taking account particularly of the characteristics of the coal used, a regular reinjection of these particles can thus be assured; it should be noted that the ratio can be different for the different motors 372,373,374.

For permitting an absorption of the variations in the quantity of particles collected by the dust removers 45,46, 47 consecutively to the repercussion, with delay, of a variation in the load of the boiler or again to a discharge of the dust removers, without perturbation of the conveyance by the duct 366 and without the reinjection into the fire box at 379 causing excessive variations in the heat output, in addition there is provided a control of the output speed of each of the motors 372,373,374, that is to say the flow rate of the drawing off means 369,370,371, to the variations of level in the respectively associated buffer storage 360,361,362, in comparison with the predetermined mean level 363,364,365; for this, there is provided means for correction of the control of the output speed of each of these motors, such that it is defined by the means 380, as a function of the information provided by the level detector 391,392,393 so that passing of the actual level of particles in one of the buffer storages above the mean predetermined level causes a flow rate of the corresponding drawing off means 369,370,371 greater than the flow rate calculated by proportionality with the load of the boiler, and on the contrary a reduction of the level below the predetermined level causes a reduction of the flow rate with respect to the flow rate calculated by proportionality with the load of the boiler; it should be noted thus that, it is in addition assured that the drawing off means 369,370,371 receive particles, in the corresponding buffer storage 360,361,362, an approximately constant force permitting them to work in approximately constant conditions, independently of successive emptyings of the associated intermediary hoppers.

The means permitting correction thus, step by step or continuously according to the type of level detector 391, 392,393 used, the speed of rotation of each of the motors 372,373,374 in a manner controlled to the measurement of the level detector 391,392,393 associated to the same buffer storage 360,361,362 have been simply shown by chain dotted connections 381,382,383; as with the means 380, they can be chosen by the man in the art from a large range of possibilities, without departing from the scope of the present invention.

The flow rate of particles in the duct 366 being thus determined, the flow rate of air in this duct, considered as a flow rate of conveying air taking account of the small part of this flow rate which is drawn off for fluidisation in the buffer storages 360,361,362 and preferably constant in terms of volume flow rate, is adjusted by action on the blower 367 so that the mass flow rate of the particles introduced into the duct 366 is in a ratio to the mass flow rate of air in this duct, of between 1 and approximately 10; these figures, given by way of non-limitative example, correspond to a high concentration of suspension of particles in air injected at 379 in the boiler, such a high concentration being favourable to the combustion of particles on their arrival in the boiler and to their incineration to the form of ashes once they are burned and find themselves on the grid 3.

Naturally, in addition to the characteristic arrangements of the invention which have been described, the man of the art will provide all the usual safety features and usual accessory arrangements; amongst these accessory arrangements will be found particularly means (not shown) for emptying of the entire installation towards appropriate solid particle storage means, and in particular means for emptying the separators 45,46,47 but it will be noted that in place of being used in the steady state as is the traditional case, these means will be used exclusively in maintenance operations of the installation, the steady state corresponding to a reinjection to the fire box 2 of all of the particles extracted from the flue gases before their evacuation to the atmosphere by the means 44.

In addition, the man of the art car provide numerous variants of the device which has been described, without departing from the scope of the present invention; these variants can particularly be made in the practical constitution of the second separation means 43, constituted in the illustrated example by three fields of an electrostatic dust remover connected in series by the flue gases duct 28; whatever their nature, a different number of these separators constituting the second separation means can be provided, and a different manner of mutual connection can be provided, and FIGS. 3 and 4 illustrate precisely two modifications, in this direction, of the device illustrated in FIG. 2.

In the case of the variant illustrated in FIG. 3, a flue gas duct 128, corresponding to the ducts 328 and connected like it to a non-illustrated boiler, divides into parallel branches 128*a* and 128*b* of which each is connected in series to two separators, respectively 145*a*, 146*a* as concerns the duct 128*a*, and 145*b* and 146*b* as concerns the duct 128*b*.

Each of these separators 145*a*,146*a*,145*b*,146*b* has a respective lower hopper 148*a*,149*a*,148*b*,149*b* opening downwards, via a respective valve 151*a*, 152*a*, 151*b*, 152*b*, into a respective intermediary hopper 154*a*,155*a*,154*b*,155*b* itself opening downwards, via a respective valve 157*a*, 158*a*, 157*b*, 158*b*, into a respective buffer storage 160*a*, 161*a*, 160*b*, 161*b*; this buffer storage opens itself downwards via continuous drawing off means, with a controllable flow rate, such as a cellular distributor respectively 169*a*,170*a*,169*b*,170*b*, onto a higher end of a vertical duct, respectively 175*a*,176*a*,175*b*,176*b*; these elements having reference numerals resulting from a substraction of 200 with respect to the reference numerals given to the elements just described with reference to FIG. 2, to which the elements in FIG. 3 are similar in their structure, their inter-relation and their function.

In this variant, in spite of a branching of the separators 145*a*,146*a*,145*b*,146*b* in series parallel, a single pneumatic conveyor duct 166, in all respects comparable to the duct 366 described above and fed as it with air under pressure via a blower 167 in all respects comparable to the blower 367, receives in a spaced manner the lower ends of the different ducts 176*b*,176*a*, 175*a*, 175*b*, in this order, for carrying the particles which it receives from these ducts, in suspension in the air, as far as the single injection means 179, in all respects comparable to the means 379 described above, to the fire box of the boiler (not shown).

In the case of the variant illustrated in FIG. 4, there is found an assembly of elements illustrated in FIG. 3, having the references increased by 100 with respect to the references that these elements have in FIG. 3, except that the single duct 166 and the single blower 167 are not duplicated; more precisely, the ducts 275*a* and 276*a*, corresponding respectively to the ducts 175*a* and 176*a*, open in a first air conveyor duct 266*a* and the ducts 275*b* and 276*b* corresponding respectively to the ducts 175*b* and 176*b* open into a second pneumatic conveyor duct 266*b*, each of the ducts 266*a* and 266*b* having a first end connected to a respective blower 267*a*, 267*b* from it injecting conveying air with an adjustable and preferably constant flow rate, and a second end to which the two conveyor ducts 266*a* and 266*b* are connected in a single pneumatic conveyor duct 266 leading to the fire box of the boiler (not shown) via injection means 279 in all respects comparable to the means 179, 79 or 379, such as an injection pipe.

In the case of this variant, there could also be provided feeding of the two ducts 266*a* and 266*b* with conveying air in parallel, by means of a single common blower 267 in place of the provision of a blower for each of them and/or the providing of distinct paths between the two ducts as far as the boiler, to the fire box of which they open then via injection means 279*a* and 279*b*, in all respects comparable to the means 179, 79 or 379, in place of there opening by means of the common injection means 279; these two possibilities are shown in chain dotted lines in FIG. 4.

Naturally, in the case of these two variants, as in the case of the embodiment illustrated in FIG. 2, the number of separators crossed in series by the flue gases, and the nature of these separators can be varied in a large measure as a function of the needs estimated by the man in the art; in the case of these embodiments illustrated in FIGS. 3 and 4 in addition, the number of branches from the flue gas duct 128 or 228 can be greater than two, the ducts then corresponding to the ducts 175*a*,176*a*,175*b*,176*b* or 275*a*,276*a*,275*b*,276*b* being able to open into a single pneumatic conveyor duct of the type illustrated at 166 in FIG. 3, or into pneumatic conveyor ducts in parallel of the type illustrated at 266*a* and 266*b* in FIG. 4, or again in series in the pneumatic conveyor ducts branched in parallel.

Naturally, although the above description makes reference to a coal boiler, the scope of the invention will not be departed from by applying it to boilers burning other solid fuels, as for example wood, husks, bagasses.

We claim:

1. A method for reinjecting flown-off particles into a solid fuel boiler, fed with fuel by means (10) arranged in a first zone (9) of the boiler fire box and which continuously projects a predetermined load of fuel along a trajectory (20) leading to a second zone (21) of the boiler, onto a grid (3) driven with a return movement (8) from the second zone (21) to the first zone (9), combustion occuring along said trajectory (20) and on the grid (3) permitting release (26) of the flue gasses entraining solid particles, said method comprising the steps of:

drawing off the flue gasses from the boiler;

leading the drawn off gasses to first separation means and separating relatively large particles from the flue gasses in said first separation means;

leading the flue gasses from the first separation means to second separation means, and separating relatively fine particles in these second separation means; and evacuating the flue gasses; and drawing off the particles in the second separation means;

this method being characterized in that the method of drawing off particles in the second separation means comprises the steps of:

(a) buffer storing the drawn off particles;

(b) continuously drawing off particles from the lower part of the buffer stored particles with an adjustable flow rate;

(c) controlling the flow rate of the drawn off particles in proportion to the load of the boiler;

(d) injecting air from a source of air under pressure arranged in proximity to the second zone (21) of the boiler and opening toward projectory (20) close to the grid (3) in second zone (21); and (e) pneumatically ducting air under pressure to draw buffer stored particles continuously to the second zone for injection.

2. A process as in claim 1 in which the fine particles are passed through a plurality of fine particles separating means.

3. A process as in claim 1 in which the ratio of particles to entraining gas stream flow rate is in a range between 1 and approximately 10.

* * * * *

UNITED STATES PATENT OFFICE

CERTIFICATE OF CORRECTION

PATENT NO. : 4,739,715

DATED : April 26, 1988

INVENTOR(S) : Michael F.E. Couarc'h, et al.

It is certified that error appears in the above-identified patent and that said Letters Patent is hereby corrected as shown below:

On the title page, please add Item --[73] Assignee:

Manutair Moller, Amiens; Stein Industrie, Velizy Villacoublay Cedex; both of France---

Signed and Sealed this

Third Day of September, 1996

*Attest:*

*Attesting Officer*

BRUCE LEHMAN

*Commissioner of Patents and Trademarks*